US005094169A

United States Patent [19]

Evitts

[11] Patent Number: 5,094,169

[45] Date of Patent: Mar. 10, 1992

[54] CARTRIDGE FOR SMALL ARMS

[76] Inventor: James E. Evitts, HC2 Box 394, Manitowish Waters, Wis. 54545

[21] Appl. No.: 648,576

[22] Filed: Jan. 31, 1991

Related U.S. Application Data

[63] Continuation-in-part of Ser. No. 422,223, Oct. 10, 1989, abandoned.

[51] Int. Cl.[5] ..... F42B 5/26

[52] U.S. Cl. ..... 102/464; 102/469

[58] Field of Search ..... 102/430, 464, 465, 466, 102/467, 468, 469, 470; 42/76.01

[56] References Cited

U.S. PATENT DOCUMENTS

| | | | |
|---|---|---|---|
| 682,364 | 9/1901 | Mangon | 102/430 |
| 1,659,625 | 2/1928 | Cowan | 42/76.01 |
| 2,402,068 | 6/1946 | Meadon | 102/464 |
| 2,573,451 | 10/1951 | Keller et al. | 102/464 |
| 2,831,287 | 4/1958 | Maillard | 102/464 |
| 3,136,084 | 6/1964 | Charron | 42/76.01 |
| 3,209,691 | 10/1965 | Herter | 102/464 |
| 3,380,157 | 8/1974 | Donnard et al. | 102/466 |
| 3,797,396 | 3/1974 | Reed | 102/464 |
| 3,998,161 | 12/1976 | Booth | 102/464 |
| 4,483,251 | 11/1984 | Spalding | 102/464 |

FOREIGN PATENT DOCUMENTS

| | | | |
|---|---|---|---|
| 764951 | 3/1934 | France | 102/464 |
| 2762 | of 1911 | United Kingdom | 102/464 |

*Primary Examiner*—Harold J. Tudor

[57] ABSTRACT

A cartridge which will produce Magnum velocities for projectiles fired by standard auto pistols, revolvers, submachine guns, or single shot firearms. This cartridge case design provides significant structural strength in the casehead web area, unlike standard straight wall cartridges, which allows increased magnum loads without casehead anomalies, ruptures and bulging. Existing auto pistol cartridge case designs have external straight wall configurations from the case mouth to the rear base rim. Existing designs also have rimless type caseheads, and bevel groove cut into the casehead wall for extraction following firing. They also exhibit nominal to thin casehead web thickness. This innovation, on the other hand, utilizes a unique thicker bevel belted casehead web, located above the extractor groove cut. The casehead expands outward on a bevel slant of about 2.1 degrees, providing greater cartridge casehead web thickness and strength when combined with the cross diagonal plane of the inner chamber radially planar bottom wall. This strengthened radial angle trussed area repels exploding inertial forces of magnum velocities.

1 Claim, 2 Drawing Sheets

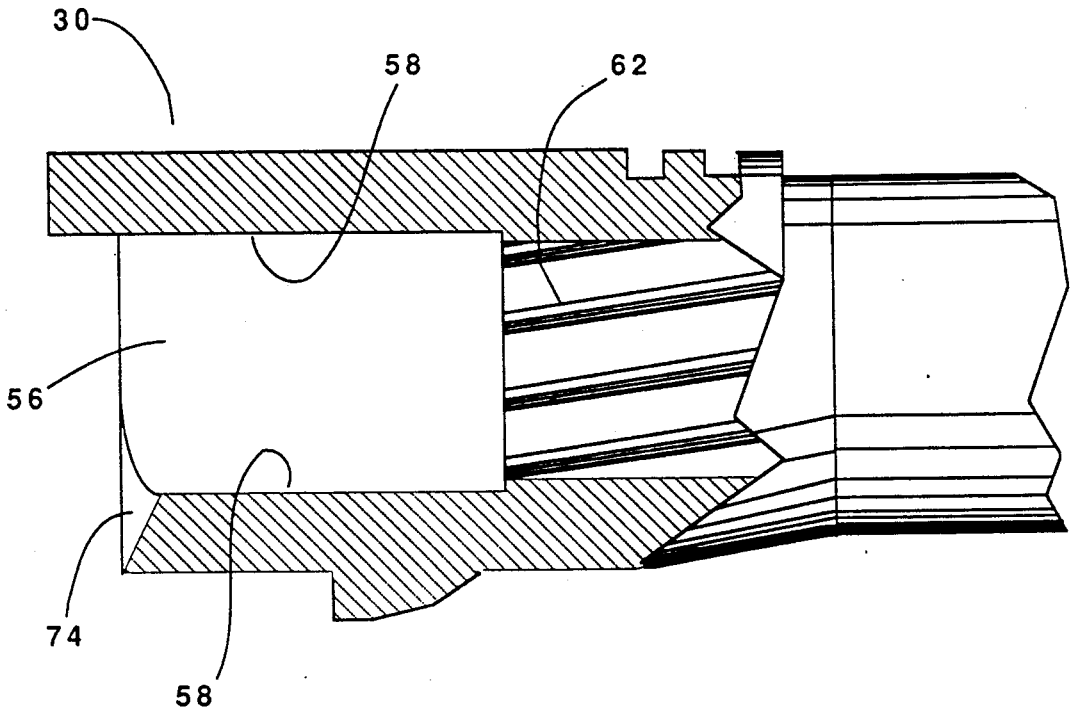
FIG 5 [ Prior Art ]
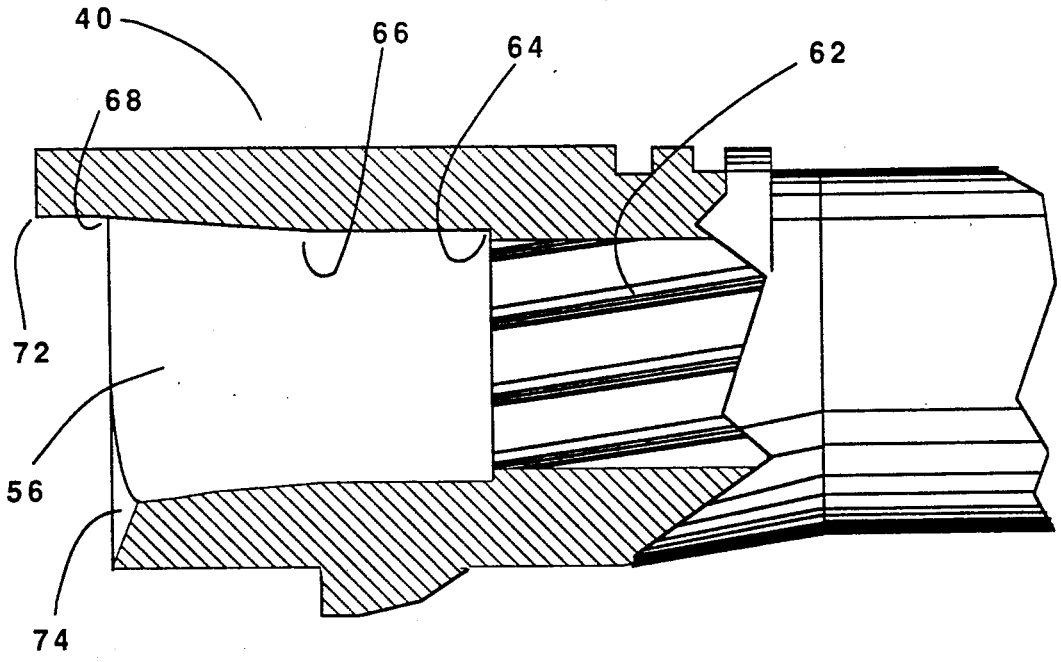
FIG 6

CARTRIDGE FOR SMALL ARMS

RELATED APPLICATION

This application is a continuation-in-part application of my copending application Ser. No.—07/422,223 filed 10, Oct. 1989, now abandoned.

BACKGROUND OF THE INVENTION

This cartridge case design and any of its apportioned chambering that will apply to variable caliber designations, is intended for automatic pistols, revolvers, submachine guns, rifles and carbines, in semi-auto, full auto, bolt action, pump, lever action or single shot configurations.

The cartridge casing upper region has a straight outer wall linear plane to its longitudinal axis, the outer casehead area below approaching the casehead has a bevel slant belted angle of about 2.1 degrees. The widest outer radial diameter of the casehead is just above the cartridge case extractor groove. This area thickness communicates with the interior powder chamber flat planar base wall most radial diameter. The casehead rear base rim is also the same diameter as the casehead's widest bevel diameter.

This thickened cartridge casehead web design strengthens the brass cartridge casing and maintains optimum inner volume capacity in the powder chamber. The casehead design has an elongated, thicker linear axis casehead from above the extractor groove, leading backward to the rear base rim. The cartridge case utilizes a typical primer pocket, but incorporates a flash hole that is longer in length.

This strengthened cartridge casehead is capable of sustaining inertial magnum forces of approximately 30,000 to 44,000 Copper Units Pressure when used in a 0.44 Auto Pistol Cartridge.

This innovative concept is first related to 0.44 caliber bullets of 10.90 mm diameter. This is the industry standard bullet loaded in 0.44 caliber firearms such as the 0.44 Special, and 0.44 Magnum caliber firearms. Use of the Bevel Belted Cartridge Case design results in a cartridge that has increased strength and optimizes powder storage capacity.

The bevel belted casehead above the extractor groove works in conjunction with the flat radial inner planar bottom wall where the primer flash-hole is located. The diagonal thickened radially trussed casehead web is extremely strong and can repel magnum exploding inertial cartridge case forces better than any generic market straight-wall auto pistol cartridge case now in existence. The BBCC [Bevel Belted Cartridge Case] design optimizes powder storage capacity, yet the 0.44 A.P.C. [Auto Pistol Cartridge] casing is shorter than the 0.44 Special or the 0.44 Magnum cartridge case; yet, it meets or exceeds afore mentioned revolver cartridge velocities depending on bullet weights.

The BBCC concept was initially designed to be used with a new 0.44 caliber chambered barrel to be utilized in standard Colt type M1911-A1 auto pistols or other makes (formerly 0.45 ACP caliber). This is an interchangeable barrel cartridge design that will produce magnum velocities for this type firearm. This design concept has much broader application in other caliber sizes and firearm makes. Use of this concept can upgrade some existing caliber firearms velocities if their steel content is of modern metallurgy.

SUMMARY AND OBJECTIVE OF THE INVENTION

It is the object of this invention to provide a new and unique safety and performance design feature never utilized in an auto pistol cartridge concept before: the Bevel Belted Cartridge Case (BBCC). All previous auto pistol cartridges have an outer case side that is straight along its linear axis length; the casehead regions are as straight as the rest of the cartridge case with a rimless type auto pistol extractor groove in the base section. Thus, they are restricted to non-magnum velocity, pressure loads—because of their nominal casehead thickness.

It is also the object of this invention to introduce a new and novel cartridge caliber known as the 0.44 Auto Pistol Cartridge (A.P.C.,). The novel aspect of the 0.44 A.P.C. chambering is that it upgrades a Colt type M1911-A1 auto pistol to magnum velocity with a change of barrels to accommodate the redesigned cartridge. All other aspects of this firearm are compatible and workable. Therefore, it is the object of this invention to be the first to utilize a 0.44 caliber bullet in a Colt type M1911-A1, formally 0.45 ACP firearm. This would also apply to all other firearm designs that utilize 0.45 ACP caliber designation, as 0.44 A.P.C. and 0.45 ACP, are barrel interchangeable, and have dual caliber conversion capability.

The 0.44 A.P.C. caliber using the BBCC concept is a one piece brass cartridge case unit that easily lends itself to mass production techniques.

The 0.44 A.P.C. auto pistol cartridge is a stronger, safer cartridge casing that extends to the user an increased safety margin with increased pressures, velocities, and foot pounds energy figures—in sub magnum type firearms.

Prototype cartridge case design length is about 23.80 mm, the commercial made product should be within the range on the order of about 24.64 mm–24.90 mm in length so it would never accidently chamber a 0.44 A.P.C. cartridge into a 0.45 a.c.p. [automatic colt pistol] barrel.

BRIEF DESCRIPTION OF THE DRAWING FIGURES

The Figures are not necessarily to scale in order to show the differences from prior art and emphasizes the details of the present invention.

FIG. 5 is cross sectional side view of a typical generic 0.45 a.c.p. barrel showing the prior art with a typical straight wall cartridge chamber wall; and FIG. 6 is cross sectional side view of a the 0.44 A.P.C. barrel with the bevel chamber wall according to the present invention.

DESCRIPTION CASEHEAD AREA

For reference to pertinent design measurements of the 0.44 a.p.c., BBCC concept please refer to drawings, FIG. 1, 2, 3, 4, 5 and 6 using numerals 3 to 74.

Figure 1:
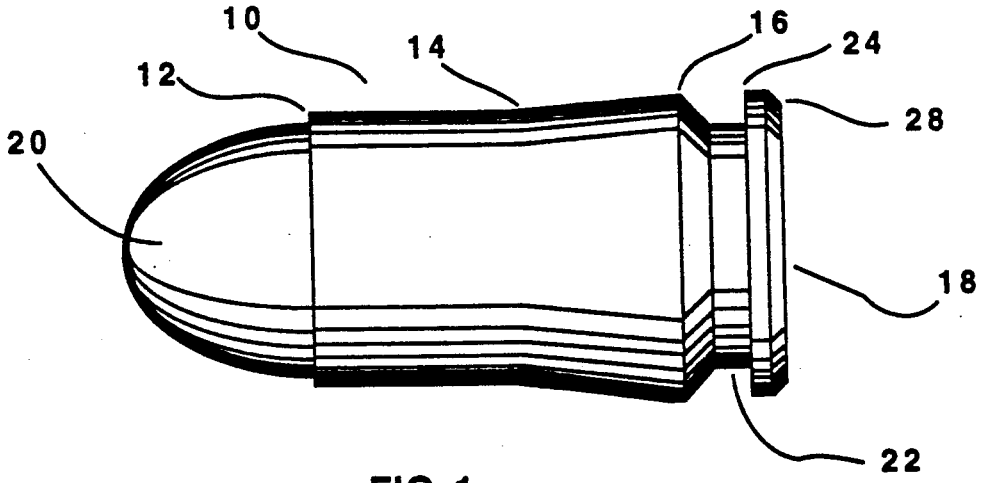
FIG. 1 is a view of the Bevel Belted Cartridge Case with a bullet therein according to the present invention.

FIG. 1 is the Bevel Belted Cartridge Case (10) with a bullet (20) there with in. The outer cylindrical wall (12) to (14) is straight of constant diameter and parallel to the longitudinal axis of the cartridge case. The outer bevel section of the cartridge case (14) to (16) is beveled typically 2.1 degrees upward above the horizontal plane to the widest diameter which is within the range on the order of about 11.91 mm–11.94 mm. The circumferential extractor groove (22) is of typical prior art design from (16) to (24) to (29) for a rimless type 0.44 A.P.C. cartridge casehead.

Figure 2:
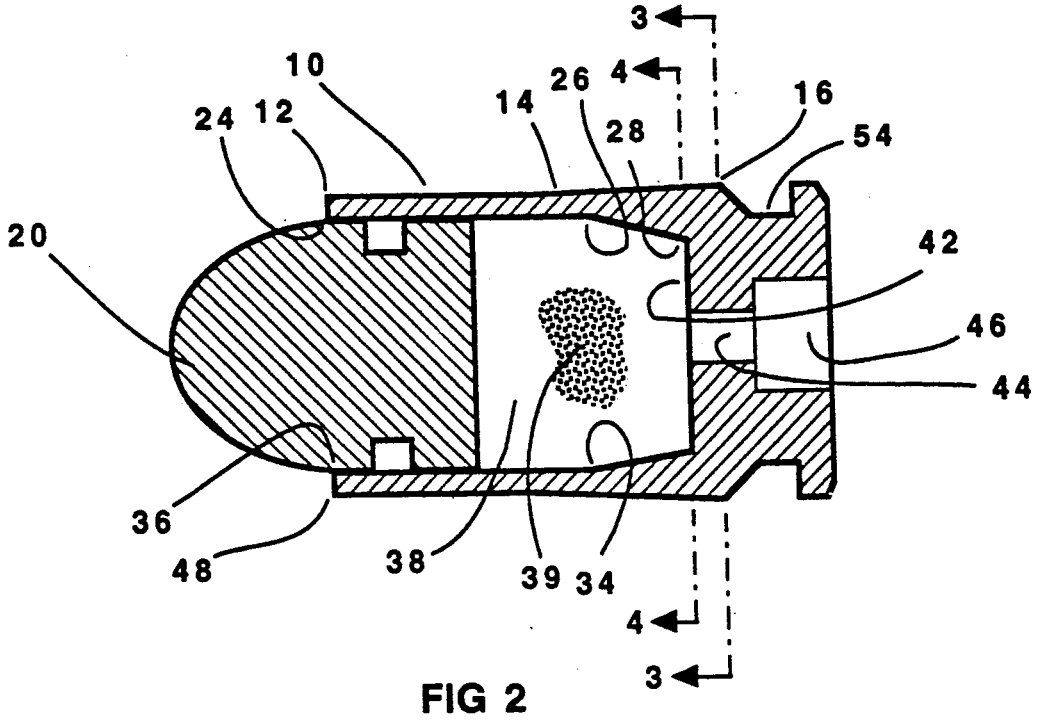
FIG. 2 is a cross sectional view of the Bevel Belted Cartridge Case with a bullet and powder chamber schematically depicted there within according to the present invention.

FIG. 2 is a cross sectional view of the Bevel Belted Cartridge Case (10) with a bullet (20) and powder chamber (38) schematically depicted. The gun powder is depicted by (39). The outer case straight wall (12) to (14) is parallel to the longitudinal axis of the cartridge case (10). The outer case wall diameter from (12) to (48) is about 11.58 mm in diameter and is then beveled outward from (14) to (16) resulting in a maximum diameter of the cartridge of about 11.91 mm. This bevel angle (14) to (16) is typically about 2.1 degrees. The cartridge length (10) should be within the range on the order of about 24.64 mm–24.90 mm in length (12) to (28) as shown in FIG. 1, so that the cartridge would never accidently chamber a 0.44 A.P.C. cartridge into a 0.45 a.c.p. [automatic colt pistol] barrel.

The inner cartridge case area is defined by (24), (26), (28), (32), (34), and (36) and is cylindrically symmetric. The inner case straight wall (24) to (26) is parallel to the longitudinal axis of the cartridge case (10) and is about 13.97 mm in length. The outer case straight wall (12) to (14) is also parallel to the longitudinal axis of the cartridge case (10) but is only about 9.35 mm in length which is shorter than the inner case wall. The inner case cartridge area tapper angle (26) to (28) is sloping downward from a diameter of within the range on the order of about 10.90 mm at (26) to a reduced diameter of within the range on the order of about 8.45 mm at (28), the planner base wall (42). The primer pocket (46) and the primer flash hole (44) are typical of prior art.

The increased strength of the Bevel Belted Cartridge Case (10) results from adding the outer bevel angle and the inner taper angle to cartridge case resulting in a thicker casehead region (14) to (26) to (28) to (54) to (16) to [14] as shown in FIG. 2.

Figure 3:
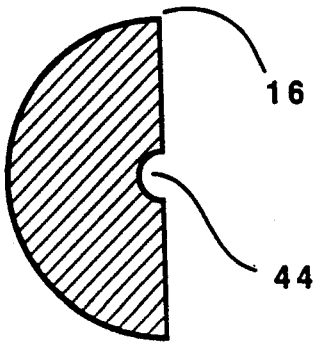
FIG. 3 is a cross sectional end view, perpendicular to the long axis of the cartridge, of the widest part of the cartridge according to the present invention.

FIG. 3 is a cross sectional end view through the cutaway view of FIG. 2 at (3), where the flash hole is (44). The widest diameter of the Bevel Belted Cartridge Case (10) is (16).

Figure 4:
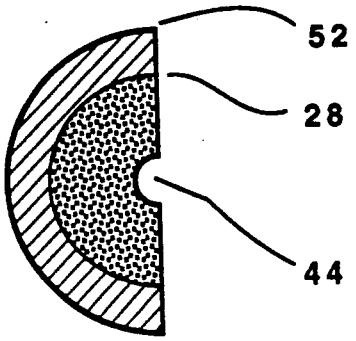
FIG. 4 is a cross sectional end view, perpendicular to the long axis of the cartridge, through the flat planar base wall according to the present invention.
Figure 1:
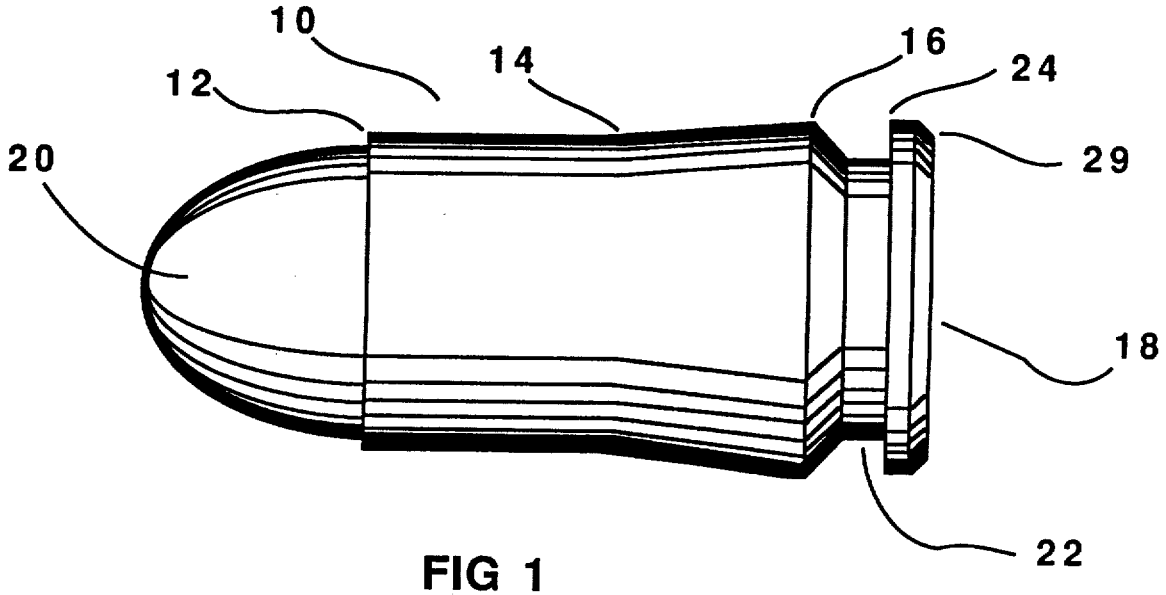

FIG. 4 is a cross sectional end view diameter through the cutaway view of FIG. 2 at (4) of the Bevel Belted Cartridge Case (10). This shows the flash hole (44), the gun powder (39) in the powder chamber (38) at the planar base wall (42). The outer diameter at this cross section is (52).

THE BARREL CHAMBER

FIG. 5 [prior art] is a typical manufactured M1911-A1 0.45 a.c.p. barrel (30). The inner chamber (56) has walls (58) for the 0.45 a.c.p. cartridge that are parallel to the longitudinal axis of the barrel and has no taper of the barrel chamber wall area. The barrel riflings (62) are shown in this figure. The barrel cartridge chamber lip feed ramp (74) is typical of the prior art.

FIG. 6 is a M1911-A1 type barrel (40) without the Bevel Belted Cartridge Case in place. The straight portion of this barrel chamber wall (64) to (66) is parallel to the longitudinal axis of the barrel which matches Bevel Belted Cartridge Case (10) contours as shown in FIG. 1. The taper of this barrel (66) to (68) also matches the Bevel Belted Cartridge Case (10) contours as shown in FIG. 1. The portion of the barrel inner chamber (68) to (72) like the prior art is parallel to the longitudinal axis of the barrel and has no taper.

The increased strength of the Bevel Belted Cartridge Case (10) requires that the barrel chamber (56) have a contour that matches the Bevel Belted Cartridge Case (10) contour.

I claim:

1. An improved cartridge case, the case including a base, an outer beveled section, a cylindrical section having a cylindrical sidewall, an inner cartridge case area and an open circular mouth, said base including a rear face and a circumferential extractor groove, said outer beveled section having a first, greater diameter adjacent said extractor groove, said outer beveled section extending to said cylindrical section at a second, lesser diameter, said cylindrical section extending between said outer beveled section and said open circular mouth, said open circular mouth having an outer diameter that is about 11.58 mm, the cylindrical section of the case is of a constant diameter of about 11.58 mm and is parallel the longitudinal axis of the case up to the start of the outer bevel, said case including a powder chamber having a planar base wall formed parallel to and spaced from said rear face and having an inner taper formed circumferential around said planar base wall, said inner taper extending outwardly to an internal surface of said cylindrical side wall at an interval circumference between said lesser diameter of said outer beveled section and said greater diameter of said outer beveled section, the outer beveled section is beveled 2.1 degrees upward above the horizontal plane to the widest diameter of the bevel which is within the range on the order of about 11.91 mm–11.94 mm, the extractor groove lies between the outer widest bevel diameter and the base, the base diameter is within the range on the order of about 11.91 mm–11.94 mm which has the same diameter as the widest part of outer bevel, the inner cartridge case area is cylindrically symmetric with the straight portion of the cylindrical section so that the cylindrical sidewall forms a straight wall parallel to the longitudinal axis of the cartridge case and about 13.97 mm in length, the inner diameter decreases from this straight section which tapers inward to about 8.46 mm in diameter at the planar base wall, the case length is within the range on the order of about 24.64 mm–24.90 mm in length so that the cartridge, a 0.44 A.P.C. cartridge, would never accidently chamber into a 0.45 A.P.C. barrel chamber.

* * * * *

UNITED STATES PATENT AND TRADEMARK OFFICE

CERTIFICATE OF CORRECTION

PATENT NO. : 5,094,169

DATED : 3/10/92

INVENTOR(S) : Evitts

It is certified that error appears in the above-identified patent and that said Letters Patent is hereby corrected as shown below:

Figure 1, should be deleted to be replaced with Figure 1, as shown on the attached pages.

Signed and Sealed this

Third Day of November, 1992

*Attest:*

DOUGLAS B. COMER

*Attesting Officer*

*Acting Commissioner of Patents and Trademarks*